US009157599B2

(12) United States Patent
Cho et al.

(10) Patent No.: US 9,157,599 B2
(45) Date of Patent: Oct. 13, 2015

(54) LIGHT EMITTING DIODE LIGHTING SYSTEM HAVING HAZE-CHANGEABLE FILM

(71) Applicant: SKC Haas Display Films Co., Ltd., Chungcheongnam-do (KR)

(72) Inventors: Hyun Seok Cho, Chungcheongnam-do (KR); Hyung Joon Paik, Gyeonggi-do (KR); Hyo Gil Cha, Chungcheongnam-do (KR); Chang Ho Kang, Chungcheongnam-do (KR); Hyun Cheol Nam, Chungcheongnam-do (KR)

(73) Assignee: SKC DISPLAY FILMS CO., LTD. (KR)

( * ) Notice: Subject to any disclaimer, the term of this patent is extended or adjusted under 35 U.S.C. 154(b) by 129 days.

(21) Appl. No.: 13/763,632

(22) Filed: Feb. 9, 2013

(65) Prior Publication Data

US 2013/0208501 A1 Aug. 15, 2013

(30) Foreign Application Priority Data

Feb. 9, 2012 (KR) ..... 10-2012-0013217

(51) Int. Cl.

| | |
|---|---|
| ***F21V 23/04*** | (2006.01) |
| ***F21V 5/00*** | (2015.01) |
| ***F21V 14/00*** | (2006.01) |
| *F21V 3/04* | (2006.01) |
| *F21Y 101/02* | (2006.01) |
| *F21Y 105/00* | (2006.01) |

(52) U.S. Cl.

CPC ..... *F21V 5/00* (2013.01); *F21V 14/003* (2013.01); *F21V 3/0409* (2013.01); *F21Y 2101/02* (2013.01); *F21Y 2105/001* (2013.01)

(58) Field of Classification Search

CPC ..... F21V 14/003; F21V 14/00
USPC ..... 362/606
See application file for complete search history.

(56) References Cited

U.S. PATENT DOCUMENTS

| | | | | |
|---|---|---|---|---|
| 5,764,316 | A * | 6/1998 | Takizawa et al. | 349/1 |
| 2006/0250541 | A1* | 11/2006 | Huck | 349/61 |
| 2007/0273265 | A1* | 11/2007 | Hikmet | 313/483 |
| 2012/0169953 | A1* | 7/2012 | Kataoka et al. | 349/36 |

FOREIGN PATENT DOCUMENTS

WO WO2011030578 * 3/2011

* cited by examiner

*Primary Examiner* — Anh Mai
*Assistant Examiner* — Zachary J Snyder
(74) *Attorney, Agent, or Firm* — Cantor Colburn LLP

(57) ABSTRACT

Disclosed is an LED lighting system comprising a housing equipped with a transparent substrate as an illuminating side, an LED light source located in the housing, and a haze-changeable film attached to the transparent substrate, wherein the transparency of the haze-changeable film changes depending on the application of electric power and the haze-changeable film has a haze on light varying with the intensity of an applied voltage/current. The LED lighting system may be useful for interior emotional lighting because a direct/indirect lighting and a mixed lighting thereof can be provided with a single system and various correlated color temperatures can be produced with a single LED light source.

9 Claims, 3 Drawing Sheets

LIGHT EMITTING DIODE LIGHTING SYSTEM HAVING HAZE-CHANGEABLE FILM

FIELD OF THE INVENTION

The present invention relates to a lighting system using a light emitting diode (LED) as a light source, more particularly to a lighting system using a haze-changeable film with an LED, which light system can be utilized for interior emotional lighting.

BACKGROUND OF THE INVENTION

Since the history of lighting began over 100 years ago with incandescent lamps converting electricity into light, filaments and discharge luminescence light sources have been widely used. However, such filaments and discharge luminescence light sources are problematic because of high power consumption and poor durability. Further, they have disadvantageously low energy efficiency because most of the supplied power is dissipated in the form of heat, while converting only about 5-28% of energy into light. Also, LEDs have been more important as a substitute for conventional light sources due to recent environmental concerns.

LEDs typically do not contain any mercury component and are thus eco-friendly. They have a long lifespan of at least fifty thousand hours and a high energy efficiency of about 90%, as compared to incandescent lamps that have low energy efficiency. Therefore, the scope of application of LEDs has been gradually broadened.

Interior lighting techniques employing an LED light source enable light emitted from the LED to pass through a transparent cover (e.g., a transparent acryl cover) to provide direct lighting, or to pass through a diffusion cover (e.g., a diffusion acryl cover) to provide indirect lighting. Currently, it is necessary to use separate lighting systems adapted for direct lighting and indirect lighting, respectively.

Further, in order to provide two or more correlated color temperatures (CCTs), it is currently necessary to employ LEDs having respective CCTs, resulting in an undesirable increase in the manufacturing costs of the lighting system.

Thus, there has been a demand for the development of novel LED lighting systems capable of addressing the above problems.

Meanwhile, as thin-film materials having various functions have been developed and researches on liquid crystal materials have been made, films capable of adjusting light transmittance or haze have recently been developed. Such a haze-changeable film or a transmittance-changeable film is manufactured by employing functional materials such as liquid crystals and suspended particles.

In a haze- or transmittance-changeable film using liquid crystals or suspended particles, the liquid crystals or suspended particles are interposed between two transparent conductive films. When an electric field is not applied, the liquid crystal molecules or suspended particles are randomly oriented. The haze of the film is maximized since light is scattered, thereby rendering the film opaque. On the other hand, when an electric field is applied, the liquid crystal molecules or suspended particles are well oriented. In such case, light passes through the film, thereby rendering the film transparent. Therefore, the average transmittance of visible light may be adjusted by controlling the intensity of an electric field.

For example, Korean Patent No. 318868 discloses liquid crystals including ferroelectric/antiferroelectric liquid crystal materials and a polymer comprised of urethane acrylate and (meth)acrylate, and a haze-changeable film using same.

Such a haze-changeable film is spotlighted for an increase in its demand, and there have been attempts to apply it to various fields.

SUMMARY OF THE INVENTION

Accordingly, it is an object of the present invention to provide an LED lighting system capable of adjusting direct lighting and indirect lighting in a single lighting system and providing various CCTs with a single LED light source by means of employing a haze-changeable film.

In accordance with one aspect of the present invention, there is provided an LED lighting system, comprising a housing comprising a transparent substrate as an illuminating side; an LED light source located in the housing; and a haze-changeable film attached to the transparent substrate, wherein the transparency of the haze-changeable film changes depending on the application of electric power, and the haze-changeable film has a haze on light varying with the intensity of an applied voltage or an applied current.

The LED lighting system according to the present invention can provide a direct lighting, an indirect lighting and a mixed lighting thereof in a single lighting system and can provide various CCTs with a single LED light source, thereby rendering it useful for interior emotional lighting and the like.

BRIEF DESCRIPTION OF THE DRAWINGS

The above and other objects and features of the present invention will be more clearly understood from the following detailed description taken in conjunction with the accompanying drawings, in which.

DETAILED DESCRIPTION OF THE INVENTION

Figure 1:
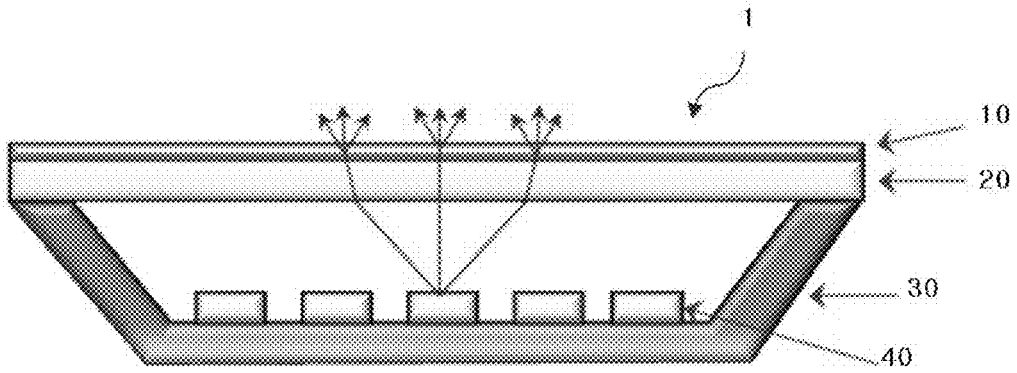
FIG. 1 shows a direct light-type LED lighting system according to an embodiment of the present invention (wherein a power source connected to a haze-changeable film is not shown)

Hereinafter, the present invention is described in detail.

The LED lighting system of the present invention comprises a housing comprising a transparent substrate as an illuminating side; an LED light source located in the housing; and a haze-changeable film attached to the transparent substrate, wherein the transparency of the haze-changeable film changes depending on the application of electric power, and the haze-changeable film has a haze on light varying with the intensity of an applied voltage or an applied current.

The haze-changeable film may be attached to the upper side and/or the lower side of the transparent substrate, or may be laminated between at least two transparent substrates.

The haze-changeable film used in the present invention has a haze on light varying with the intensity of an applied voltage or an applied current. The haze of the haze-changeable film may change in inverse proportion to the intensity of an applied voltage or an applied current. The beam angle of light that has passed through the transparent substrate to which the haze-changeable film has been attached may vary in proportion to the level of haze. Accordingly, the LED lighting system according to the present invention may provide a direct lighting, an indirect lighting, or a mixed lighting thereof depending on the haze level of the haze-changeable film.

For example, when a voltage or a current is not applied to the haze-changeable film, the film becomes opaque at a maximum haze so that light emitted from the LED light source is diffused while passing through the film, resulting in an effect of indirect lighting. In contrast, when a voltage or a current is applied to the haze-changeable film, the film becomes transparent at a minimum haze so that light emitted from the LED light source directly passes through the film without diffusion thereof, resulting in an effect of direct lighting. Further, in case where a voltage or a current is applied to the haze-changeable film at an intermediate intensity, the film becomes translucent at an intermediate level of haze, thereby producing a mixed effect of direct lighting and indirect lighting.

The haze-changeable film used in the present invention may have a spectral transmittance, i.e., light transmittance at different wavelengths, varying with the intensity of the voltage or current applied. Thus, the haze-changeable film can change the correlated color temperature (CCT) of emitted light, i.e., light passing through the haze-changeable film. In the LED lighting system, the haze and the spectral transmittance of the haze-changeable film may independently be adjusted by different electric factors, such as voltage, current, etc. For example, if the LED lighting system is designed to use voltage as a factor for controlling the haze, current may be used as a factor for adjusting the spectral transmittance or CCTs. Consequently, both of the haze and the CCT of the LED lighting system can be simultaneously adjusted.

Accordingly, the LED lighting system according to the present invention can change the CCT of lighting even when the same light source is used.

Any film may be used for the haze-changeable film so long as its transparency changes depending on the application of electric power and it has a haze on light varying with the intensity of an applied voltage or an applied current.

Preferably, the haze-changeable film may comprise a haze-changeable layer containing one or more liquid crystals or one or more suspended particles; and transparent conductive films laminated on both sides of the haze-changeable layer. The transparent conductive films may be an indium tin oxide (ITO)-based film.

Also, the haze-changeable layer may contain, as the liquid crystals, polymer-dispersed liquid crystals (PDLC) or polymer-assembled liquid crystals (PALC). For example, the liquid crystals may be selected from the group consisting of nematic liquid crystals, ferroelectric liquid crystals and antiferroelectric liquid crystals, which are mixed with a polymer resin, e.g., an acrylic resin, in the haze-changeable layer (see Korean Patent No. 318868).

Alternatively, the haze-changeable layer may have a composition wherein a suspended solution containing light-polarizing particles as suspended particles is dispersed in the form of fine droplets in a polymer resin.

Examples of a commercially available haze-changeable film may include films manufactured by NSG (Nippon Sheet Glass), Asahi Glass, and Central Glass, Japan; RFI (Research Frontiers Incorporated), USA; Saint Gobain, France; and SPDI, DM Display, and Kukyoung G&M, Korea.

In the LED lighting system according to the present invention, the transparent substrate may be a transparent glass, a transparent acryl plate, etc.

The LED light source may be any one typically used in an LED lighting system.

The housing may be any one typically used in an LED lighting system and is not limited to specific shapes and materials.

The LED lighting system according to the present invention may be a direct light-type wherein light emitted from the LED light source directly reaches the transparent substrate; or a side light-type wherein a light guide plate is additionally disposed between the transparent substrate and the LED light source and light emitted from the LED light source reaches the transparent substrate through the light guide plate.

FIG. 1 illustrates a direct light-type LED lighting system according to the present invention. The direct light-type LED lighting system 1 is configured such that at least one LED light source 40 is located inside a housing 30 and a transparent substrate 20 is located on the opposite side. The transparent substrate 20 serves as a cover of the housing 30. A haze-changeable film 10 is laminated on the transparent substrate 20. Light emitted from the LED light source 40 directly travels toward the transparent substrate 20, passes through the transparent substrate 20 and the haze-changeable film 10, and is emitted toward outside the direct light-type LED lighting system 1.

Figure 2:
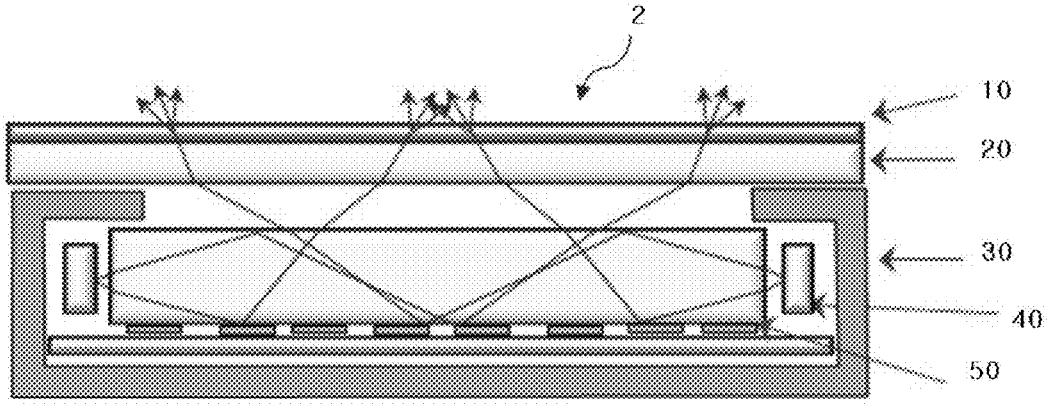
FIG. 2 shows a side light-type LED lighting system according to another embodiment of the present invention (wherein a power source connected to a haze-changeable film is not shown)

FIG. 2 illustrates a side light-type lighting system according to the present invention. The side light-type LED lighting system 2 is configured such that at least one LED light source 40 is located inside a housing 30 at a side position with respect to a transparent substrate 20, which serves as a cover of the housing 30. A haze-changeable film 10 is laminated on the transparent substrate 20. A light guide plate 50 is disposed inside the housing 30 between the transparent substrate 20 and the LED light source 40 such that light emitted from the LED light source 40 travels through the light guide plate 50, passes through the transparent substrate 20 and the haze-changeable film 10, and is emitted toward outside the side light-type LED lighting system 2.

In the direct light-type LED lighting system 1 and the side light-type LED lighting system 2 according to the present invention, a power source, which is not shown in FIGS. 1 and 2, is connected to each of the haze-changeable film 10 and the LED light source 40.

The LED lighting system according to the present invention can convert light emitted from the LED light source into a direct lighting, an indirect lighting, or a mixed lighting thereof by adjusting the haze level of the haze-changeable film. Further, the LED lighting system can change the uniformity and the beam angle of light emitted from the LED light source.

Figure 3:
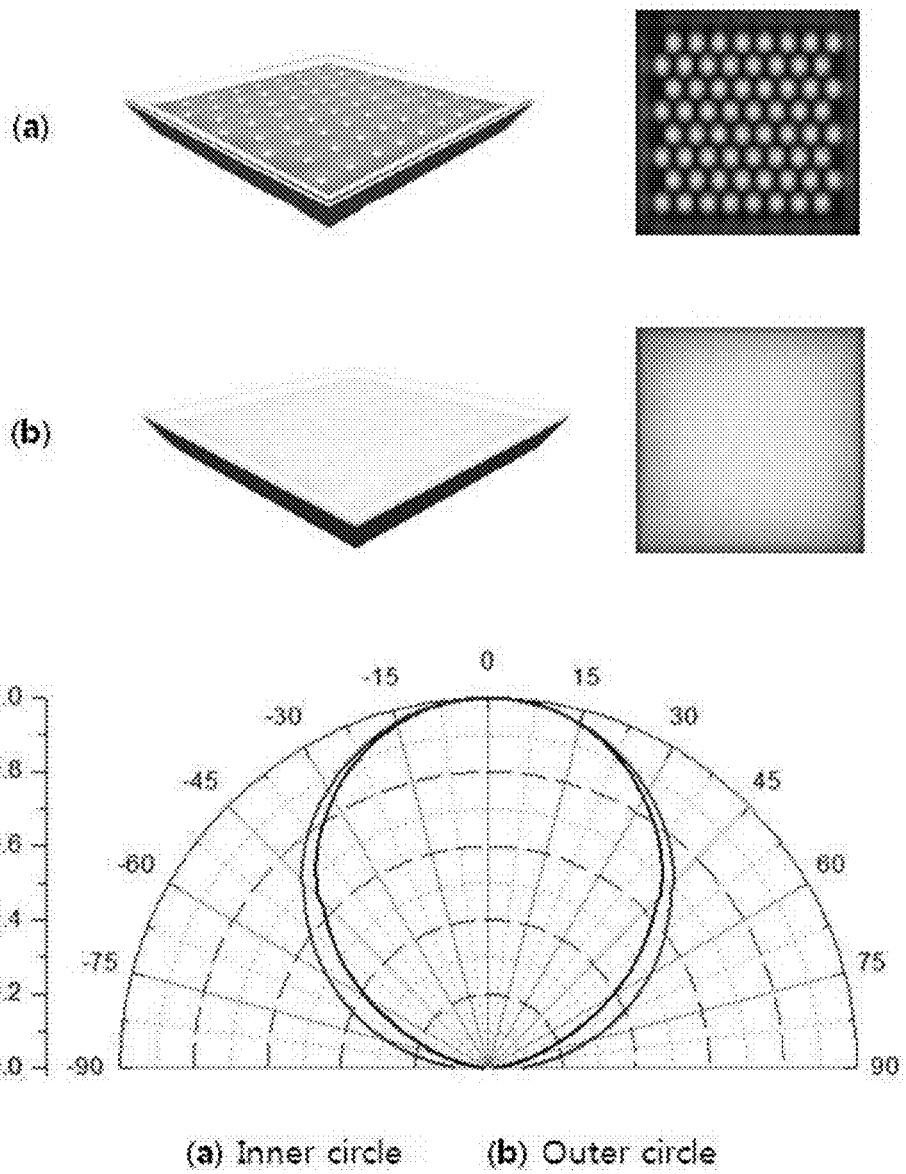
FIG. 3 shows changes in the appearances and the beam angles of an LED lighting system depending on whether the haze-changeable film is transparent or hazy (a: transparent state, b: hazy state)

FIG. 3 illustrates the appearance and the beam angle of the LED lighting system according to an embodiment of the present invention, depending on the changes in haze of the haze-changeable film. As shown in the upper part of FIG. 3, when the haze function of the haze-changeable film is turned off (a), the haze-changeable film becomes transparent so that light emitted from the LED light source is completely transmitted. On the other hand, when the haze function of the haze-changeable film is turned on (b), the haze-changeable film becomes translucent or opaque, whereby light emitted from the LED light source is diffused while passing through the film, resulting in an effect of soft and indirect lighting. As depicted in the lower part of FIG. 3, the results of the beam angle test indicate that the uniformity and the beam angle of the LED lighting may increase when the haze-changeable film is in a hazy state (b) than when it is in a transparent state (a).

Figure 4:
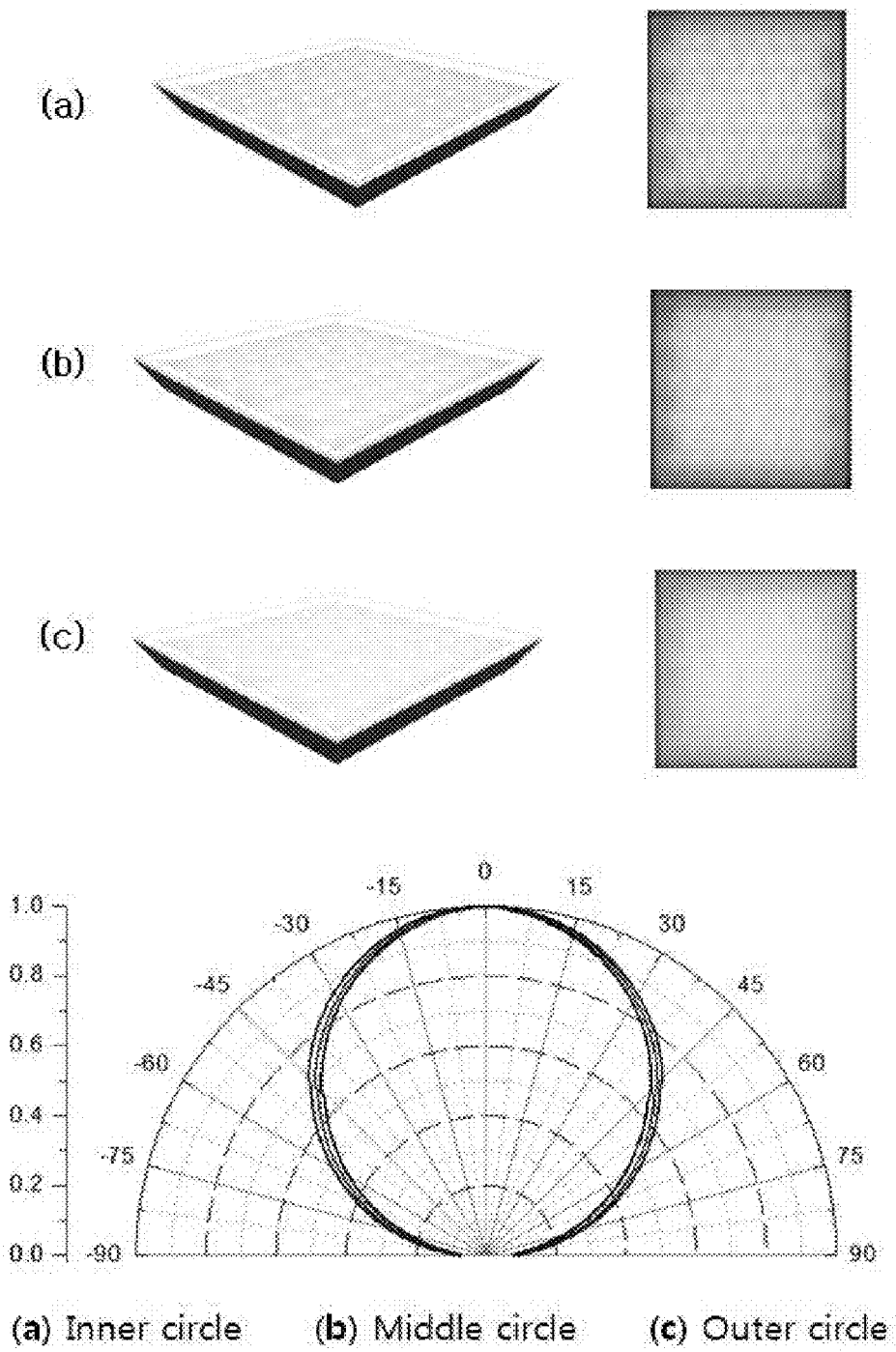
FIG. 4 shows changes in the appearances and the beam angles of an LED lighting system depending on the level of haze (a: low haze, b: intermediate haze, c: high haze).

FIG. 4 illustrates the appearance and the beam angle of the LED lighting system according to an embodiment of the present invention, depending on the haze level of the haze-changeable film. As shown in the upper part of FIG. 4, the appearances of the LED lighting system changes as the haze level of the haze-changeable film increases from a low haze (a) via an intermediate state (b) to a high haze (c). That is, the ratio between direct lighting and indirect lighting can be adjusted by way of controlling the haze level of the haze-changeable film. As depicted in the lower part of FIG. 4, the beam angle of light emitted from the LED light source may increase in proportion to an increase in the haze level of the haze-changeable film from (a) via (b) to (c).

Further, the LED lighting system according to the present invention may adjust the spectral transmittance in the haze-changeable film so that light emitted from a single LED light source can be emitted toward outside the LED lighting system at different CCTs of 4,000 K, 5,300 K, 6,500 K, etc., without the need for conventional multiple LED light sources. Therefore, the LED lighting system according to the present invention, which uses a single LED light source, can generate light having various CCTs by adjusting the spectral transmittance of the haze-changeable film, thereby providing emotional lighting.

As described above, the LED lighting system according to the present invention is advantageous since it can provide a direct lighting, an indirect lighting and a mixed lighting thereof by means of employing a single haze-changeable film, as compared to a conventional LED lighting system, which requires separate transparent and diffusion sheets to provide a direct lighting and an indirect lighting, respectively. Moreover, the inventive LED lighting system can provide various CCTs although it uses only a single LED light source, thereby reducing the number of LED light sources, which are conventionally required to provide various CCTs. Accordingly, the present LED lighting system can ultimately reduce the manufacturing costs thereof, which is advantageous in marketing the lighting system in the LED lighting industry. The inventive LED lighting system is useful for interior emotional lighting and the like.

While the invention has been described with respect to the above specific embodiments, it should be recognized that various modifications and changes may be made to the invention by those skilled in the art which also fall within the scope of the invention as defined by the appended claims.

What is claimed is:

1. A light emitting diode (LED) lighting system comprising:

a housing comprising a transparent substrate as an illuminating side;

an LED light source located in the housing; and a haze-changeable film attached to the transparent substrate, wherein the transparency of the haze-changeable film changes depending on the application of electric power, and the haze-changeable film has a haze on light varying with the intensity of an applied voltage or an applied current, wherein a change in a haze of the haze-changeable film is related to a change in one of a voltage and a current applied to the haze-changeable film and a change in a color temperature of the haze-changeable film is related to a change in the other of the voltage and the current applied to the haze-changeable film.

2. The system of claim 1, wherein the LED lighting system provides a direct lighting, an indirect lighting, or a mixed lighting thereof depending on the haze level of the haze-changeable film.

3. The system of claim 1, wherein the haze-changeable film has a spectral transmittance varying with the intensity of the applied voltage or the applied current and changes the correlated color temperature (CCT) of emitted light.

4. The system of claim 1, wherein light emitted from the LED light source directly reaches the transparent substrate.

5. The system of claim 1, further comprising a light guide plate between the transparent substrate and the LED light source, wherein light emitted from the LED light source reaches the transparent substrate through the light guide plate.

6. The system of claim 1, wherein the transparent substrate is selected from the group consisting of a transparent glass and a transparent acryl plate.

7. The system of claim 1, wherein the haze-changeable film is laminated between at least two transparent substrates.

8. The system of claim 1, wherein the haze-changeable film comprises a haze-changeable layer containing one or more liquid crystals or one or more suspended particles, and indium tin oxide (ITO)-based transparent conductive films laminated on both sides of the haze-changeable layer.

9. The system of claim 8, wherein the liquid crystals are selected from the group consisting of nematic liquid crystals, ferro electric liquid crystals and antiferro electric liquid crystals, and the liquid crystals are mixed with a polymer resin in the haze-changeable layer.

* * * * *